United States Patent [19]

Credle, Jr.

[11] Patent Number: 4,544,328

[45] Date of Patent: Oct. 1, 1985

[54] SOLD-OUT DEVICE FOR SYRUP PUMP

[75] Inventor: William S. Credle, Jr., Stone Mountain, Ga.

[73] Assignee: The Coca-Cola Company, Atlanta, Ga.

[21] Appl. No.: 432,840

[22] Filed: Oct. 5, 1982

[51] Int. Cl.[4] ..... F04B 49/00; F04B 11/00; B67D 5/08

[52] U.S. Cl. ..... 417/33; 417/46; 417/540; 222/66; 251/61.3

[58] Field of Search ..... 417/21, 33, 38, 46, 417/53, 393, 540, 542; 222/64, 66; 251/61.3; 92/98 D

[56] References Cited

U.S. PATENT DOCUMENTS

| | | | |
|---|---|---|---|
| 1,042,980 | 10/1912 | Shawver | 417/46 |
| 2,178,953 | 10/1937 | Chilton | 92/98 D |
| 2,328,812 | 9/1943 | Klein | 417/46 X |
| 2,765,743 | 10/1956 | Hollinshead | 417/44 |
| 2,765,804 | 10/1956 | Dinkelkamp | 417/46 X |
| 2,852,033 | 9/1958 | Orser | 417/542 |
| 3,326,089 | 6/1967 | Machado | 92/98 D X |
| 3,363,412 | 1/1968 | Fischer et al. | 251/61.3 X |
| 3,590,859 | 7/1971 | Gotzenberger | 251/61.3 X |
| 3,738,776 | 6/1973 | Debare | 417/44 X |
| 3,746,036 | 7/1973 | DuBois et al. | 251/61.3 X |
| 3,802,462 | 4/1974 | Trösch | 251/61.1 X |
| 3,816,025 | 6/1974 | O'Neill | 417/46 X |
| 3,851,661 | 12/1974 | Fernandez | 417/540 X |
| 3,874,417 | 4/1975 | Clay | 417/540 X |
| 4,247,018 | 1/1981 | Credle | 222/64 X |

FOREIGN PATENT DOCUMENTS

| | | | |
|---|---|---|---|
| 469509 | 11/1950 | Canada | 251/61.3 |

*Primary Examiner*—William L. Freeh
*Assistant Examiner*—Paul F. Neils
*Attorney, Agent, or Firm*—Birch, Stewart, Kolasch & Birch

[57] ABSTRACT

A control device associated with a pneumatically-driven demand pump comprising a valve system which shuts off the gas which drives the pneumatic pump in response to a pressure-sensitive diaphragm which detects variations in pressure in the fluid output from the pump. The pressure-sensitive diaphragm serves the dual function of suppressing surges of liquid flow from the pump and stopping the pump when the liquid pressure drops below a predetermined minimum by closing a valve to shut off the gas.

7 Claims, 4 Drawing Figures

SOLD-OUT DEVICE FOR SYRUP PUMP

BACKGROUND OF THE INVENTION

The present invention relates to a pneumatically-powered demand pump utilized in a post-mix beverage syrup dispensing system and, more specifically, to a control device which will stop the rapid cycling of the pump when there is no longer a supply of syrup at the pump inlet and will suppress surges in the syrup output from the pump.

Diaphragm pumps are widely used, particularly for pumping liquid solutions and highly viscous materials under conditions such that the viscosity of the fluid being pumped, the head on the suction side of the pump and the back pressure on the pump discharge may all vary depending on the use of the pump. Examples of such pumps are disclosed in U.S. Pat. Nos. 3,741,689 to Rupp; 4,123,204 to Scholle; and 3,172,698 to Hinz, et al. These pneumatically-powered demand pumps normally continue to pump until a predetermined outlet pressure is reached. The pump will continue to pump a particular fluid, such as syrup, until the inlet gas pressure to the pump from the pneumatic power supply can no longer overcome the fluid pressure in the outlet line of the pump. When the suction line of a demand pump is connected to an empty, nonvented container, the pump is unable to suck enough fluid so as to pressurize the outlet line to a level above the aforementioned inlet gas pressure, so the pump cannot turn itself off. Thus, the pump will dry cycle indefinitely under these circumstances, wasting gas and possibly damaging the pump. This condition can develop due to a blocked or defective suction line or an empty syrup supply package.

On occasions during the operation of a pneumatically-powered demand pump, a partially blocked or defective suction line may produce surging of the liquid being pumped. Such a condition leads to uneven supply of the liquid medium and poor quality control of the product produced. Although certain devices have been proposed which control and regulate the air input to such a pneumatically-powered system, in most instances these devices are electrically powered or vacuum operated. In the case of an electrically powered control device, the requirement for the use of electricity inherently is a negative feature, increasing the cost of the operation. The use of a vacuum sensing device at the pump inlet will only work with sealed, nonvented containers and will not work with vented containers. Vacuum sensing control devices also do not work well when used in conjunction with other vacuum-operated devices such as vacuum-operated switchover valves which are frequently used in syrup dispensing systems.

SUMMARY OF THE INVENTION

Accordingly, it is a primary object of the present invention to provide a control device for a pneumatically-powered demand pump which will overcome the above-noted and other disadvantages.

It is a further object of the present invention to provide a control device for a pneumatically-powered demand pump which protects the pump from overworking, regulates gas consumption from the pneumatic power supply and, when necessary, completely shuts down the supply of gas to the pump.

Another object of the present invention is to provide a non-electrically powered control device for a pneumatically-powered demand pump which regulates and controls the pneumatic input.

Still a further object of the present invention is to provide a control device for regulating and controlling the pneumatic input to a pneumatically-powered demand pump which works well with both vented and nonvented liquid supply containers.

Yet still another object of the present invention is to provide an air flow control device for a pneumatically-powered demand pump which is actuated by pressure changes in the liquid output from the pump, and operates reliably over a broad range of flow conditions.

It is still a further object of the present invention to provide a control device for a pneumatically-powered demand pump which acts as a surge suppressor for the liquid output from the pump.

The foregoing objects and others are accomplished in accordance with the present invention by providing a control device for a pneumatically-powered demand pump which will suppress surges of the liquid output and, if necessary, shut off the pump when there is no longer a supply of liquid, such as syrup, at the pump inlet.

The control functions of the device are responsive to changes in liquid pressure at the pump outlet and said device comprises:

first conduit means for accommodating the flow of liquid output from said pump;

second conduit means for accommodating the flow of gas to drive said pump;

surge-suppressor means for suppressing surges of liquid flow through said first conduit means caused by changes in pressure of said liquid and sensing said changes in pressure; and valve means for shutting off the flow of gas through said second conduit means when the pressure of said liquid sensed by said surge-suppressor means falls below a predetermined value.

The valve means includes a valve stem which is coupled to both the surge-suppressor means and a sealing element of said valve so that movements of the surge-suppressor means are accompanied by movements of the same distance by the valve sealing element.

The surge-suppressor means is preferably a flexible diaphragm hermetically mounted in an opening in a side wall of said first conduit means and movable transversely thereof in response to liquid pressure changes therein. The diaphragm is attached to one end of the valve stem. A coil spring biases the valve stem and the diaphragm inwardly of the first conduit to suppress liquid surges therein. The spring also functions to close the valve sealing element when the liquid pressure in the first conduit drops below a predetermined minimum.

The valve sealing element may be an O-ring on the valve stem or preferably another flexible diaphragm similar to the surge-suppressor diaphragm.

A manual priming (override) lever is provided at the opposite end of the valve stem from the surge-suppressor diaphragm. The priming lever may be manually moved to open the valve to permit the flow of gas to the pump until the liquid or syrup pressure at the pump outlet is high enough to hold the valve open.

BRIEF DESCRIPTION OF THE DRAWINGS

The invention is further illustrated by way of the accompanying drawings, which are intended to illustrate, but not limit, the subject matter of the present invention, and wherein.

DETAILED DESCRIPTION OF THE DRAWINGS

Figure 1:
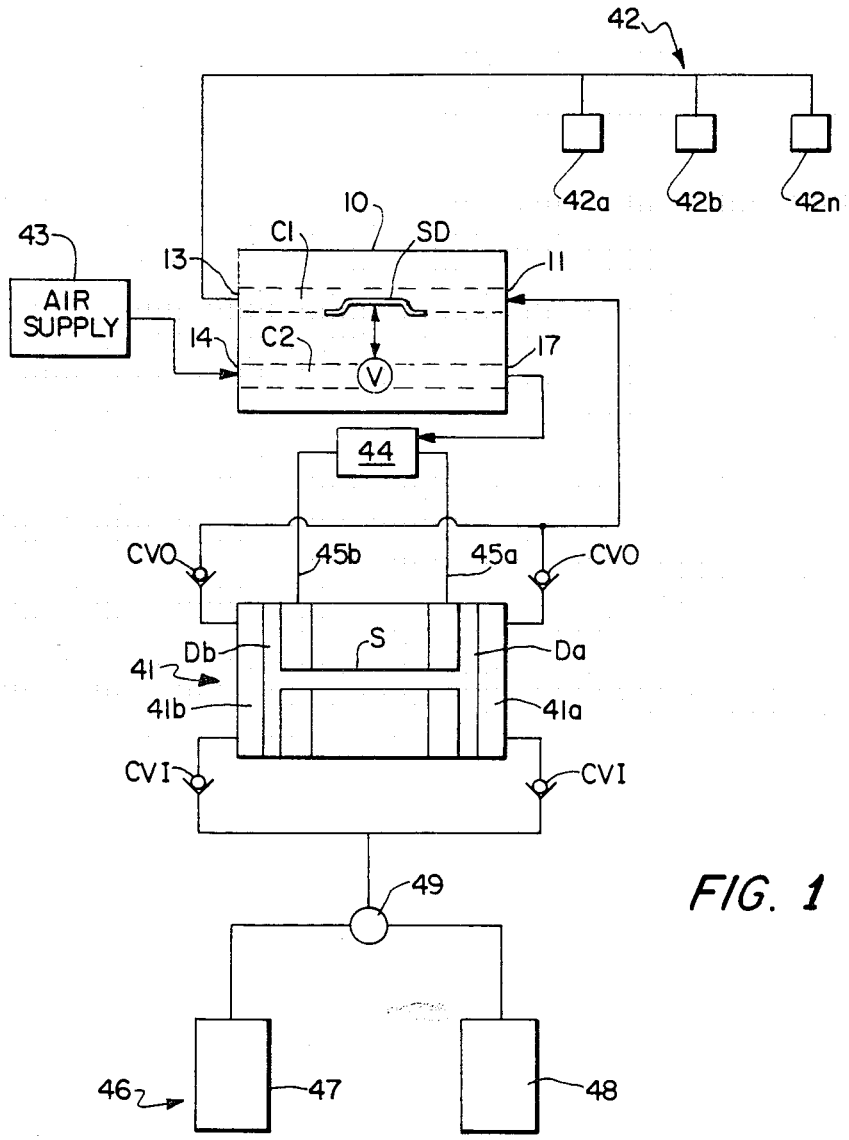
FIG. 1 is a schematic diagram showing the interrelationship between the flow control device of the present invention and a representative pump and fluid dispensing system.

The functions of the control device of the present invention can be best understood by reference to the schematic diagram of FIG. 1, illustrating the control device 10 in circuit with a pneumatically-powered (air-powered) demand pump 41. Pump 41 may be any suitable reciprocating diaphragm pump such as disclosed in the aforementioned U.S. Pat. Nos. 3,741,689; 4,123,204; and 4,172,689. Said patents are incorporated herein by reference.

Such a pump typically includes a reciprocating shaft S connected between a pair of diaphragms Da, Db in pump chambers 41*a*, 41*b*, respectively. Gas to drive the pump is alternately supplied to the inboard sides of diaphragms Da, Db by a reversing valve 44 via lines 45*a*, 45*b*. As the pump reciprocates liquid in chambers 41*a*, 41*b* on the outboard sides of diaphragms Da, Db is alternately discharged through outlet check valves CVO. Reversing valves suitable for use as valve 44 are also disclosed in the aforementioned pump patents.

FIG. 1 illustrates a pump 41 of the above-described type in fluid circuit with a post-mix beverage dispenser system. The flow control device 10 of the present invention is connected between the pump output check valves CVO and a plurality of post-mix beverage dispenser valves 42 (42*a*, 42*b*, 42*n*). Syrup is supplied to the pump chambers 41*a*, 41*b* through inlet check valves CVI. A syrup supply system 46 may include first and second groups of syrup sources 47, 48 coupled through a changeover valve 49. Examples of a semi-automatic changeover valve and associated bag-in-box syrup sources are described in U.S. Pat. No. 4,275,823 to William S. Credle and U.S. Pat. No. 4,014,461 to William A. Harvill, which are incorporated herein by reference. These bag-in-box syrup sources are unvented and the bags thereof collapse to create a vacuum when empty. This vacuum is utilized to actuate the changeover valve 49. For this reason, prior art vacuum control devices in fluid circuit with valve 49 on the input side of pump 41 cannot be effectively used to shut off the operation of pump 41 when the supply of syrup is depleted. That is, such a vacuum sensor will interfere with the operation of changeover valve 49 and vice-versa. In contrast, the control device 10 of the present invention disposed on the output side of pump 41, will not interfere with the operation of valve 49.

In addition, the control device 10 will operate satisfactorily with vented syrup supply containers, if desired.

The control device 10 of the present invention includes: a first conduit C1 for accommodating the flow of syrup output from pump 41 via check valves CVO; fluid input port 11; a fluid output port 13; and a flexible diaphragm SD for sensing pressure changes and suppressing surges of syrup in conduit C1. Diaphragm SD is coupled within control device 10 to a valve V disposed in a second conduit C2 for accommodating the flow of air from air supply 43 via input port 14. When syrup pressure in conduit C1 is above a predetermined level, valve V is opened, permitting air from conduit C2 to flow from output port 17 to reversing valve 44. The air is then alternately supplied through lines 45*a*, 45*b* to pump chambers 41*a*, 41*b* in the fashion previously described to drive the pump.

However, when the pressure in the syrup in conduit C1 drops below a predetermined minimum, diaphragm SD moves to close valve V, shutting down the supply of air to pump 41 and the pump stops. Diaphragm SD also functions to suppress surges of syrup flow from conduit C1 to dispenser valves 42 in a manner to be described more fully hereinafter with reference to the specific embodiments of FIGS. 2 to 4.

Figure 2:
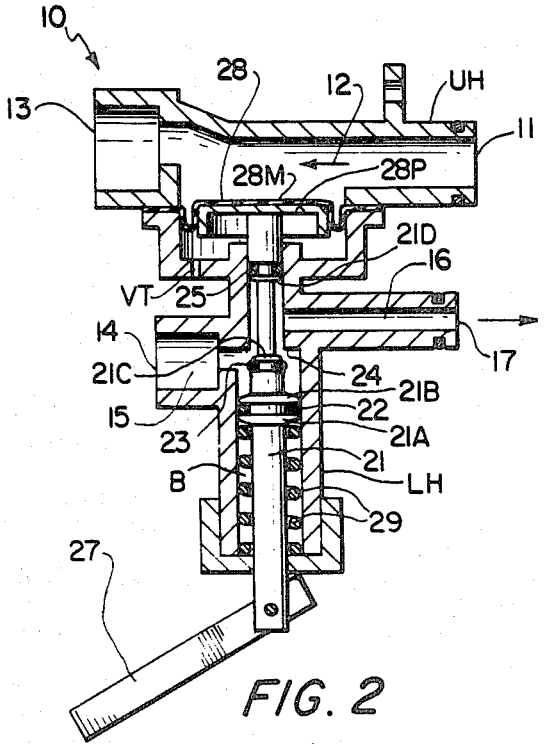
FIG. 2 represents a side sectional view of one embodiment of a flow control device of the present invention.
Figure 3:
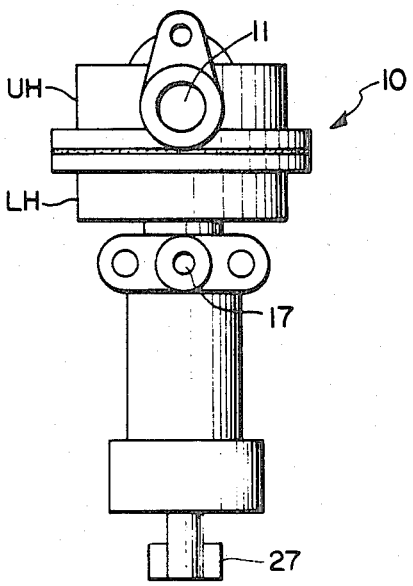
FIG. 3 is an end elevational view of the right side of the device of FIG. 2.

Referring now to FIGS. 2 and 3, there is illustrated one embodiment of a flow control device of the present invention, generally designated 10, comprising a syrup inlet 11, a first conduit 12 for accommodating the flow of syrup, and a syrup outlet 13 integrally formed in an upper housing portion UH. The syrup inlet 11 of the flow control device receives the syrup from a demand pump, such as 41 of FIG. 1, and discharges it to the post-mix beverage dispenser nozzle 42. The air which drives the demand pump 41 enters control device 10 through an air inlet 14 in a lower housing portion LH, and is directed through chamber 15 through a valve corresponding to V of FIG. 1 opening to the air outlet 17 via a second conduit 16. The air passes to the demand pump via reversing valve 44 of FIG. 1 to drive the diaphragms Da, Db thereof to pump syrup through the first conduit 12. The lower housing portion LH also has a vertically disposed central bore B.

The valve corresponding to V of FIG. 1 is provided within the lower housing bore B of the control device 10 and includes a valve stem 21, an O-ring valve sealing element 23 and a seat 24. O-ring seals 22, 25 are also provided on stem 21 and are supported by retaining flanges 21A, 21B and 21D, respectively. Flange 21C retains the O-ring valve sealing element 23 in place and is of small enough outside diameter to clear valve seat 24 when moved upwardly to close the valve.

A priming lever 27 is secured to the bottom of valve stem 21 and provides a means for manually overriding the control device when it is in the closed position. Lever 27, when depressed downwardly in the position illustrated in FIG. 2, resets the control device 10 to permit the flow of air into the pump until the syrup pressure output from the pump is high enough to hold the valve sealing element 23 open.

A pressure-sensitive element herein represented as a diaphragm 28, has a flexible membrane 28M, which can be secured or not to a piston 28P, centrally secured to the top end of valve stem 21, and has peripheral portions of membrane 28M sandwiched between housing portions UH, LH. Diaphragm 28 responds to pressure changes within the first conduit 12 such that the valve sealing element 23 connected thereto will move in unison with, and an equal distance to, diaphragm 28.

The diaphragm 28, valve stem 21, and valve sealing element 23 are continuously biased upwardly by a coil spring 29, compressed between the bottom of the control device housing and flange 21A. If the pressure within the first conduit 12 drops below a predetermined value, such as by a depletion of the syrup supply or a blocked or defective suction line, the spring 29, surrounding valve stem 21 and biased against flange 21A, will urge the valve element 23 against the valve seat 24 to close off the flow of air from the air inlet 14 to the second conduit 16. Thus, when the flow of syrup ceases or is interrupted, the decrease in syrup pressure within the first conduit 12 causes the valve sealing element 23 to shut off the air flow which stops the cycling of the pump 41.

Depending upon the cause of the pressure decline, once syrup is again available to the suction line of the pump, the priming lever 27 is actuated or reset to the position shown in FIG. 2, so as to reopen the valve sealing element 23. Once the pump outlet syrup pressure is high enough to hold the valve element 23 open, the priming lever 27 is released.

As discussed hereinbefore, the control device of the present invention also serves as a surge-suppressor when used, for example, with a reciprocating air-powered pump. Small fluctuations or pulses may be smoothed out by the spring-loaded pressure-sensitive element 28 which moves transversely against the syrup in first conduit 12 to adjust the syrup pressure toward a constant value. The distance between the valve sealing element 23 and the valve seat 24, in a fully open valve position as illustrated in FIG. 2, may be predetermined to control the size of the surge to be smoothed out before the air flow is completely shut off by valve sealing element 23. This is possible because diaphragm 28 and valve sealing element 23 move in unison over equal distances.

The control device 10 in the embodiment of FIGS. 2 and 3 also includes a vent port VT.

FIG. 3 illustrates an end elevational view of the right side of the air flow control device 10 of FIG. 2, with corresponding numbers representing like elements.

Figure 4:
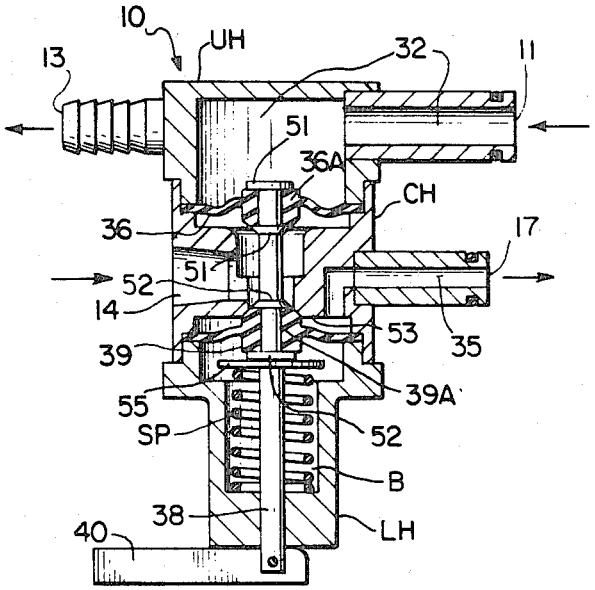
FIG. 4 is a preferred embodiment of a control device of the present invention.

Referring to FIG. 4, there is illustrated a preferred embodiment of the control device of the present invention again generally designated 10.

In this embodiment, the device 10 includes a three-piece housing including an upper housing portion UH, central housing portion CH and lower housing portion LH. A central bore B is defined by housing portions CH, LH. The air for driving the pump, such as 41 of FIG. 1, enters through inlet 14 in central housing portion CH, and exits via second conduit 35 and outlet 17. The pressure-sensitive diaphragm 28 of the FIG. 2 embodiment is replaced in the FIG. 4 configuration by a diaphragm 36 sandwiched at its periphery between housing portions UH, CH, and having a centrally disposed plug-shaped projection 36A supported between flanges 51 on the top end of a valve stem 38, mounted for reciprocating movement in bore B. A second diaphragm 39, having a centrally disposed, plug-shaped projection 39A supported between flanges 52, is positioned at approximately the mid-point of valve stem 38 for sealing engagement with a valve seat 53. The periphery of diaphragm 39 is sandwiched between housing portions CH, LH. A coil spring SP, similar to spring 29 of FIG. 2, is disposed in bore B in compression against flange 55 on valve stem 38, and thus biases valve stem 38 and diaphragms 36, 39 upwardly, as viewed in FIG. 4. Therefore, a drop in pressure of syrup in conduit 32 below a predetermined level is sensed by pressure-sensitive diaphragm 36, and will permit spring SP to shift the valve stem 38 axially in bore B so as to seat the plug-shaped projection 39A of diaphragm 39 against valve seat 53. This closes off the air passage from the air inlet 14 to the air outlet 16 via second conduit 35, to stop the pump 41, as described hereinbefore. The configuration set forth in FIG. 4 may be referred to as a double diaphragm type of air flow control device, since both the pressure-sensitive and valve-sealing elements are diaphragms.

The double diaphragm embodiment of FIG. 4 is advantageous in that it does not require the O-ring seals, such as 22 and 25 of FIG. 2, on the valve stem. Thus, the valve stem can move more freely with less drag. Therefore, the FIG. 4 embodiment is considered to be the preferred embodiment of the present invention.

The diaphragm 36 of FIG. 4 also functions as a surge-suppressor in the same manner as diaphragm 28 of FIG. 2 in conjunction with the bias force of spring SP.

The embodiments of the flow control device of the present invention, as described in connection with FIGS. 1 to 4 function both as a surge suppressor for dampening small fluctuations or pulses within the liquid output from the pump, and for shutting off the pump, thus protecting the pump from rapid cycling and the accompanying unnecessary gas consumption when the supply of syrup at the pump inlet is depleted. This condition can be caused by an empty syrup supply unit or a blocked or defective suction line. In the former situation, the device of the present invention may function as a "sold-out" indicator which monitors the liquid capacity of its liquid (syrup) supply unit. In addition, due to the fact that the device is activated by pressure, not flow, it will function properly over a broad range of flow conditions. Also, the multiple-piece housing construction permits the device to be easily disassembled and sanitized. The compactness of the device also permits it to be directly mounted on an associated pump.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. In a post-mix beverage dispenser system including a pneumatically-driven demand pump for pumping syrup between a syrup supply to a dispenser nozzle, a flow-regulating control device for said pump comprising:

first conduit means for accommodating the flow of syrup output from said pump;

second conduit means for accommodating the flow of gas to drive said pump;

surge-suppressor means for suppressing surges of syrup flow through said first conduit means caused by changes in pressure of said syrup and sensing said changes in pressure; and valve means for shutting off the flow of gas through said second conduit means when the pressure of said syrup sensed by said surge-suppressor means falls below a predetermined value.

2. The device of c1aim 1, wherein said surge-suppressor means comprises a flexible member coupled to a valve actuator means and a biasing means, said flexible member being movable inwardly of said first conduit means transversely to the flow of said syrup through said first conduit means by said biasing means to positions fluctuating in response to changes in syrup pressure to thereby adjust said pressure within said first conduit means to a substantially constant value, said valve means moving a fixed distance in response to movement of said flexible member to shut off the flow of said gas through said second conduit means when said pressure within said first conduit means drops below a predetermined limit.

3. The device of claim 1, wherein said surge-suppressor means comprises a piston covered by a flexible membrane and said biasing means comprises a spring.

4. The device of claim 1, further including manual means for resetting said valve means in an open position to permit the flow of said gas until the syrup pressure is high enough to hold said valve means open.

5. The device of claim 1, wherein said surge-suppressor means includes a movable member which moves inwardly, transversely of said first conduit means in response to said decreases in syrup pressure to thereby adjust said pressure toward a substantially constant value;

actuator means coupling said movable member of said surge-suppressor means and valve means together for movement over equal distances in said transverse direction;

said valve means closing to shut off said gas flow when said distances exceed a predetermined limit.

6. The device of claim 1, wherein said valve means comprises a movable diaphragm operatively associated with a valve seat.

7. The device of claim 6, wherein said surge-suppressor means comprises a movable diaphragm.

* * * * *